United States Patent [19]

Mortvedt

[11] Patent Number: 4,579,343

[45] Date of Patent: Apr. 1, 1986

[54] GRAPHITE COMPOSITE RACQUET

[75] Inventor: Raymond L. Mortvedt, La Mesa, Calif.

[73] Assignee: Ektelon, San Diego, Calif.

[21] Appl. No.: 537,058

[22] Filed: Sep. 29, 1983

Related U.S. Application Data

[63] Continuation of Ser. No. 332,870, Dec. 21, 1981, abandoned, which is a continuation of Ser. No. 112,091, Jan. 14, 1980, abandoned.

[51] Int. Cl.[4] ..... A63B 49/10

[52] U.S. Cl. ..... 273/73 D; 273/DIG. 7; 273/DIG. 23; 273/DIG. 8; 273/DIG. 3; 273/DIG. 9

[58] Field of Search ..... 273/DIG. 7, DIG. 23, 273/73 F, 73 C, 326, 82 R, DIG. 8, DIG. 3, DIG. 9

[56] References Cited

U.S. PATENT DOCUMENTS

| | | | |
|---|---|---|---|
| 3,402,932 | 9/1968 | Conklin et al. | 273/82 R |
| 3,507,495 | 4/1970 | Tucker et al. | 273/326 |
| 3,755,037 | 8/1973 | Erwin et al. | 273/73 F |
| 3,787,051 | 1/1974 | Johns | 273/DIG. 7X |

FOREIGN PATENT DOCUMENTS

| | | | |
|---|---|---|---|
| 2336952 | 7/1977 | France | 273/73 F |
| 1434741 | 5/1976 | United Kingdom | 273/73 F |
| 1207840 | 10/1970 | United Kingdom | 273/DIG. 7 |

OTHER PUBLICATIONS

"Modmor High Modulus Carbon Fibres", Engineering Materials and Design, Mar. 1969, p. 7.

*Primary Examiner*—Richard C. Pinkham
*Assistant Examiner*—Matthew L. Schneider
*Attorney, Agent, or Firm*—Oldham, Oldham & Weber Co.

[57] ABSTRACT

A molded composite racquet is provided, wherein the frame of the entire racquet is prepared using the combination of continuous graphite fibers longitudinal within the shape of the frame, wrapped in a bias arrangement with layers of fiberglass, that combination being covered by a protective resinous outerlayer. The presence of the graphite fiber in a unidirectional orientation around the hoop of the racquet in the plane of the strings increases the resistance against compression with minimal affect on the flexibility, bending or torsion, of the racquet. The concentric and bias orientation of the fiberglass layer supplies sturdiness to increase the resistance to torsion and bending stress. The molded composite racquet achieves a controlled impulse duration during impact with a game ball which provides greater control during impact and less shock to the user of the racquet during the recreation.

5 Claims, 2 Drawing Figures

GRAPHITE COMPOSITE RACQUET

This is a continuation application of U.S. Ser. No. 332,870 filed Dec. 21, 1981, now abandoned, which in turn is a continuation application of U.S. Ser. No. 112,091, filed Jan. 14, 1980, now abandoned.

BACKGROUND OF THE INVENTION

This invention relates to molded composite racquets having the combination of graphite fibers surrounded by fiberglass layers in a bias orientation.

Heretofore, the use of racquets has multiplied according to the introduction of new racquet sports. Likewise, the kind of material used to form the frame of each type of racquet has been expanded according to the particular requirements of the recreational activity. Racquet sports, such as tennis, squash, racquetball, badminton and others have benefited from the use of various alloys of metal, including aluminum, magnesium, titanium, and steel. As well as other composite material design concepts and wood. However, in the case of wood and metals, because of the relative densities of the materials previously used, sacrifice of strength and stiffness of material was necessitated by the reduction of excess weight. Therefore, an improvement to the strength control of stiffness, and a reduction in the weight, of the frame is achieved by various resinous composites, either of the thermoplastic or the thermosetting plastic type. U.S. Pat. No. 3,981,504 discloses a composite racquet which uses a resinous material reinforced by various, random fibrous material. However, resolution of the various stresses applied to the racquet during recreation are not maximized under this construction. Other racquet constructions have attempted to resolve stresses by modifications to composite type, quantity and orientation. For example, U.S. Pat. No. 3,755,037 teaches a composite racquet construction having a fluid filled interior. U.S. Pat. No. 3,787,051 teaches a tennis racquet entirely made from resin impregnated glass fibers continuously oriented with the hoop of the head of the racquet. Further, U.S. Pat. No. 3,840,230 discloses a multi-layered racquet having a synthetic resin interior and two fiber-reinforced plastic outside layers. U.S. Pat. No. 3,483,055 discloses a racquet having flexible, windable materials cured on a form.

It has been found that the stress resolution for racquets required more than the introduction of resinous material and fiberglass to the construction of the frame, for the distribution of flexibility and mass requirements are not adequately controlled by these constructions. Therefore, a need exists for the preparation of a composite racquet which reduces the weight of the frame, more optimally resolves the physical stresses in the frame during use, controls the flexibility distribution and controls the mass distribution.

SUMMARY OF THE INVENTION

Therefore, it is an object of the invention to provide a composite racquet, wherein the weight of the racquet is reduced for added mobility during use.

Another object of the invention is to provide a composite racquet, as above, wherein the strength of the composite material exceeds metal, wood, and injection molded plastic racquets presently used by providing a construction which resolves the physical stress tolerances of the racquet during use.

These and other objects of the invention, which will become more apparent as the detailed description of the preferred embodiment proceeds, are achieved by: a racquet comprising a frame molded from a multiplicity of continuous carbonaceous fibrous material longitudinally within the shape of the frame surrounded by a plurality of continuous resin-filled fibrous glass layers, wrapped in a bias arrangement to said continuous carbonaceous fibrous material.

DESCRIPTION OF THE DRAWINGS

For an appreciation of the invention, reference is had to the drawings, wherein.

DETAILED DESCRIPTION OF THE PREFERRED EMBODIMENTS

Figure 1:
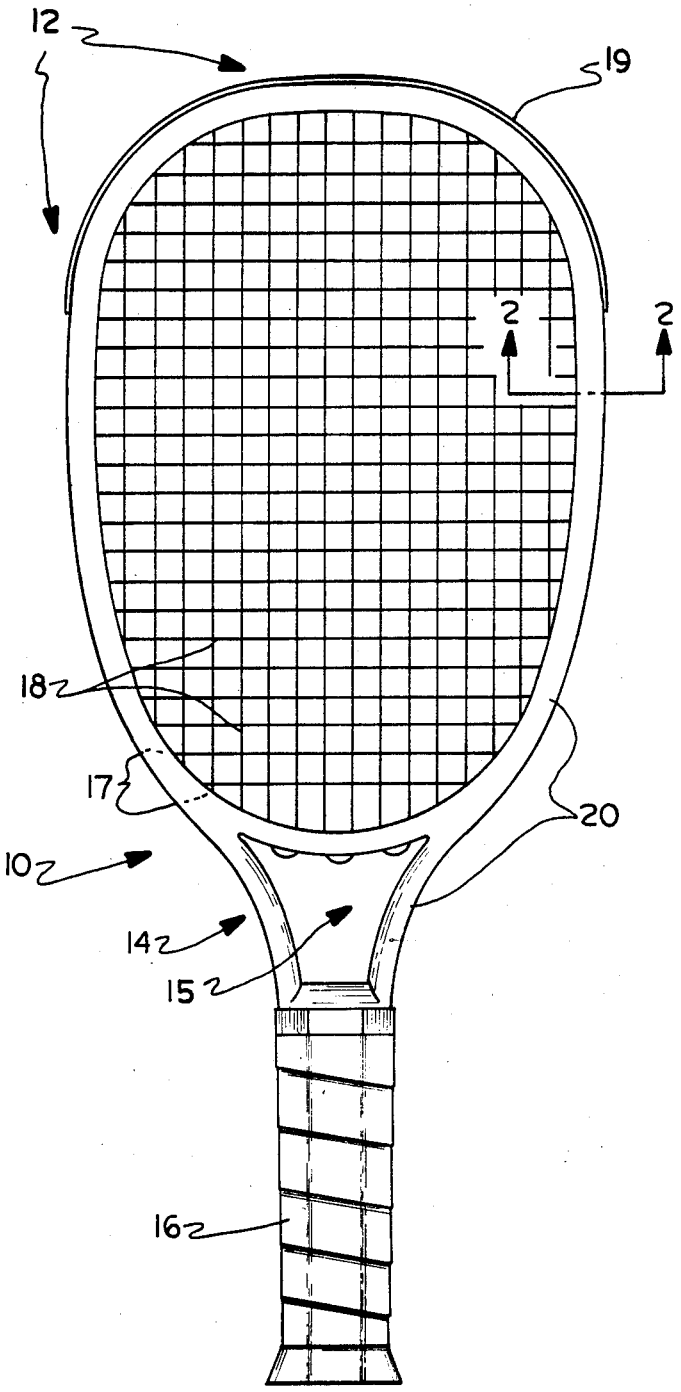
FIG. 1 is a front-plan view of the racquet having the composite frame.
Figure 2:
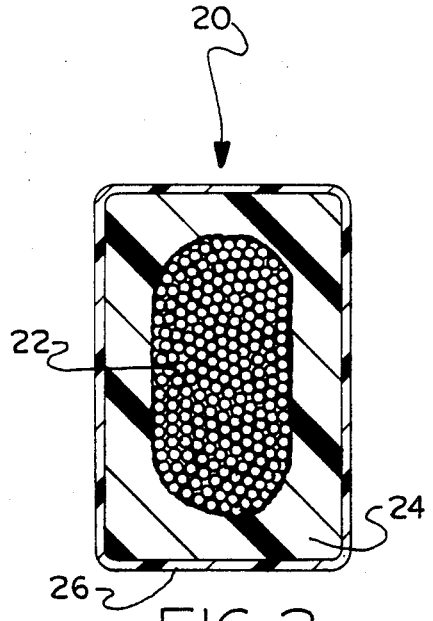
FIG. 2 is a cross-sectional view, taken on lines 2—2 FIG. 1, showing the orientation and arrangement of the materials combined to form the composite.

For an explanation of the use of the invention and its preferred embodiment, reference is had to FIGS. 1 and 2, wherein FIG. 1 demonstrates the use of the composite frame 20 in a racquetball racquet. The racquet, generally referred to as 10, may be a tennis racquet, racquetball racquet, squash racquet, badminton racquet, or any other racquet for a sport that requires the use of strings 18 under tension. Racquetball is the preferred use for racquet 10. Racquet 10 is composed of contact portion 12 having bumper 19, neck portion 14 typically designed with an orifice 15 to minimize wind resistance, and a handle portion 16. Strings 18 are connected to contact portion 12 by means of string channels 17 bored within composite frame 20. As the requirements for individual racquets vary, contact portion 12, neck portion 14 and handle portion 16 vary in size, but the composition of frame 20 is maintained without altering the scope of the invention.

Referring now to FIG. 2, a cross-sectional view of frame 20 may be seen and the composite of frame 20 understood. Within the frame 20 are a multiplicity of carbonaceous fibrous material typically composed of graphite. This fibrous material 22 exists in continuous strands in a longitudinal orientation to the shape of the racquet frame. That is to say, the carbonaceous fibrous material 22 serves as the core of frame 20 throughout contact portion 12, neck portion 14, and handle portion 16, the latter to the extent necessary.

About the core of carbonaceous fibrous material 22 are a plurality of layers of continuous resin-filled fibrous glass 24, typically composed of fiberglass sheets continuously wrapped or wound about the carbonaceous fibrous material 22 surrounding the same. The number of layers of continuous fiberglass 24 varies according to the stiffness required to resist torsion and bending, within the tolerances, known to those skilled in the art, for varying degrees of flexible racquets. Fibrous glass 24 is continuously wrapped about carbonaceous fibrous material 22 in a bias orientation from about 10° to about 80° relative to the axis of the core of material 22. Preferably, the bias arrangement comprises an angular arrangement from about 20° to about 60°.

Surrounding fiberglass layers 24 is a resinous protective layer 26 which becomes the outer layer for the racquet frame 20. Layer 26, typically composed of urethane paint, epoxy resin, or non-woven polyester, is designed to protect the strength components of the frame 20, namely concentric fiberglass layer 24 and the multiplicity of graphite fibers 22. Frame 20 and layer 26 may be formed and shaped by conformance of the pliable materials comprising layers 24 and 26 within a mold during the cure cycle of manufacture.

The racquet frame 20 achieves the synergistic strength resulting from the torsional stiffness improvement contributed by fiberglass layer 24, in combination with the improvement to the compression stiffness achieved by the carbonaceous fibrous material 22. At impact, material 22 provides a necessary compression-stiffness rate to generate an impulse effect tuned to the duration of string/ball contact. With this tuned impulse, that being the comparison of force generated versus time elapsed, greater energy is conserved during the impact of the ball or other projectile which provides more power to the ball. Increased duration of contact during impact permits a greater control over the ball during the stroke of the racquet 10, and a reduction in shock to the handle portion 16 and, hence, to the player using the racquet.

This high impulse effect tuned to the duration of string/ball contact achieved by the longitudinal orientation of the carbonaceous fiber material 22 does not impede the requirements for bending and torsion of the racquet frame 20. The continuous concentric wrapping of fiberglass 24 in layers about graphite fibers 22 generate a high torsion-bending stiffness ratio which prevents the angle of impact of the ball or other projectile from adversely affecting the stroke of the racquet 10. Furthermore, placing spin or "English" upon the ball is improved by the torsional resistance provided by layers 24 in combination with the greater impulse effect provided by fibers 22. Therefore, the composition of frame 20 resolves the physical stresses placed upon the racquet 10 during impact of a ball, such that the improved compression stiffness of fibers 22, and the torsional stiffness provided by layers 24, provide an unexpected and synergistic strength balanced between the high impulse effect and the resistance to torsion.

By way of explanation, Table I compares the types of materials available to those skilled in the art with the composite material of the present invention.

TABLE I

| MATERIAL | Tensile Strength (psi) | Tensile Modulus (psi) | Density lbs/in$^3$ |
|---|---|---|---|
| MATERIAL COMPARISONS | | | |
| Aluminum: | | | |
| 6061-T6 | 40,000 | $10 \times 10^6$ | .10 |
| 7005-T53 | 50,000 | $16 \times 10^6$ | .16 |
| Titanium | 30–100,000 | $16 \times 10^6$ | .16 |
| Steel | 120,000 | $30 \times 10^6$ | .28 |
| "ADVANCED" COMPOSITES (THERMOSET) | | | |
| Frame (20) | | | |
| Material (22) | 200,000 | $20 \times 10^6$ | .05 |
| Material (24) | 70,000 | $3 \times 10^6$ | .07 |
| Boron | 190,000 | $30 \times 10^6$ | .07 |
| Kevlar | 190,000 | $10 \times 10^6$ | .05 |
| 1543 Glass | 100,000 | $4.3 \times 10^6$ | .07 |

TABLE I-continued

| MATERIAL | Tensile Strength (psi) | Tensile Modulus (psi) | Density lbs/in$^3$ |
|---|---|---|---|
| MATERIAL COMPARISONS | | | |
| INJECTION MOLDED THERMOPLASTIC | | | |
| Molding Compounds: | | | |
| "Lo Cost" Frames | 18,000 | $1.2 \times 10^6$ | .05 |
| "Graphite" Frames | 35,000 | $2.0 \times 10^6$ | .05 |

While it is apparent that the composite frame 20 composed of materials 22 and 24 has minimal density compared with the metal racquets, and similar densities to that of wood and thermoplastic racquets, the composite tensile strength of materials 22 and 24 in composite frame 20 is superior to that of any other material or composite presently available. In order to achieve overall strength, described above without increased density, composite frame 20 has achieved a balance of torsional stiffness and compression stiffness not otherwise found in the present materials compared in Table I. Therefore, while its tensile modulus is not greater than all other materials, sacrifice to overall tensile modulus is more than compensated by additional tensile strength. This compensation is reflected in the balance of higher impulse effect during impact of the ball against the racquet strings 18.

While in accordance with the patent statutes, a best mode and preferred embodiment have been disclosed, it is to be understood that the invention is not limited thereto or thereby. Consequently, for an understanding of the scope of the invention, reference is had to be the following claims.

What is claimed is:

1. A racquet comprising:

a frame molded from an integral solid homogeneous central core of a multiplicity of continuous carbonaceous fibrous material longitudinally within the shape of the frame surrounded by a plurality of continuous resin-filled glass layers, wrapped in a multiple overlapped bias arrangement to said core of said continuous carbonaceous fibrous material; and wherein the same materials of composition are used throughout the length of said frame.

2. A racquet according to claim 1, wherein said frame further has a protective outer layer, selected from the group consisting of epoxy, urethane, non-woven polyester and combinations thereof, surrounding said layers of said continuous resin-filled fibrous glass fibers, and wherein wrapped glass layers interact to achieve a balance of tortional stiffness and compression stiffness, and the wrapped glass layers comprise a substantial portion of the mass of the frame.

3. A racquet according to claim 2, wherein said continuous carbonaceous fibrous material comprises graphite fibers.

4. A racquet according to claim 3, wherein said bias arrangement comprises from about 10° to about 80°.

5. A racquet according to claim 4, wherein said bias arrangement comprises 20° to 60°.

* * * * *